US007556169B2

(12) United States Patent
Cooper et al.

(10) Patent No.: US 7,556,169 B2
(45) Date of Patent: Jul. 7, 2009

(54) AUTOMATIC LOCKING MECHANISM

(75) Inventors: Brian Cooper, Vincennes, IN (US); Brian Bichey, Newburgh, IN (US)

(73) Assignee: Toyota Motor Manufacturing North America, Inc., Erlanger, KY (US)

( * ) Notice: Subject to any disclaimer, the term of this patent is extended or adjusted under 35 U.S.C. 154(b) by 503 days.

(21) Appl. No.: 11/227,409

(22) Filed: Sep. 15, 2005

(65) Prior Publication Data

US 2007/0062963 A1 Mar. 22, 2007

(51) Int. Cl.
*B65D 45/22* (2006.01)
*B65D 43/22* (2006.01)
*B65D 45/16* (2006.01)

(52) U.S. Cl. ..... 220/326; 220/768; 220/745; 292/80

(58) Field of Classification Search ..... 220/326, 220/324, 835, 830, 810, 833, 845, 768
See application file for complete search history.

(56) References Cited

U.S. PATENT DOCUMENTS 1,441,326 A * 1/1923 Blocker ..... 220/326
1,525,108 A * 2/1925 Triggs ..... 220/254.3
1,928,962 A * 10/1933 Carter ..... 220/326
3,746,207 A * 7/1973 Lenhart ..... 220/326
3,789,550 A 2/1974 Seiwert
3,966,084 A * 6/1976 Box ..... 220/326
4,032,035 A * 6/1977 Tepas et al. ..... 220/318
4,739,896 A * 4/1988 Moss ..... 52/169.6
4,788,840 A 12/1988 Wilson, Jr.
4,901,882 A * 2/1990 Goncalves ..... 220/324
4,941,588 A 7/1990 Flider
4,952,160 A * 8/1990 Olsen ..... 439/142
4,959,980 A 10/1990 Phillips
5,042,853 A 8/1991 Gleason et al.
5,129,537 A 7/1992 Bordner et al.
5,131,558 A * 7/1992 Hiromori ..... 220/326
5,156,293 A * 10/1992 Petterson et al. ..... 220/326
5,193,707 A * 3/1993 Mizumura ..... 220/326
5,199,286 A 4/1993 Jakubas
5,234,124 A * 8/1993 Buckner et al. ..... 220/326
5,328,046 A 7/1994 Kutz et al.
5,438,935 A 8/1995 Seitz
5,826,447 A 10/1998 Campbell (Continued)

OTHER PUBLICATIONS

Self-Closing Drum Cover information printed from www.newpig.com.

(Continued)

*Primary Examiner*—Anthony D Stashick
*Assistant Examiner*—Niki M Eloshway

(57) ABSTRACT

A cover for a container is provided in one embodiment. The cover has an upper side and an underside. The underside comes in physical contact with a container when the cover is in a closed position. A hinge pivotally secures the cover to the container. A lock is secured opposite the hinge and on the underside of the cover. The lock automatically and securely affixes the cover to the container when the cover is in the closed position. A release is positioned on the upper side of the cover to disengage the lock and releases the cover from the container. In another embodiment, the cover tilts at an angle when not fully closed, revealing a high contrast color on the upper inner sidewall of the container, providing a visible indication that the container is open.

14 Claims, 3 Drawing Sheets

U.S. PATENT DOCUMENTS

| | | | | |
|---|---|---|---|---|
| 5,875,915 | A | 3/1999 | Bradshaw et al. | |
| 5,875,948 | A * | 3/1999 | Sadler | 224/404 |
| 5,927,773 | A | 7/1999 | Larsen et al. | |
| 5,931,330 | A | 8/1999 | Starr | |
| 5,954,218 | A | 9/1999 | Starr | |
| 5,983,682 | A | 11/1999 | Parikh | |
| 6,085,940 | A | 7/2000 | Ferri, Jr. | |
| 6,176,385 | B1 * | 1/2001 | Feese et al. | 220/326 |
| 6,336,740 | B1 * | 1/2002 | Keough | 366/247 |
| 6,588,624 | B1 * | 7/2003 | Connors et al. | 220/827 |
| 6,830,159 | B2 * | 12/2004 | Caldwell et al. | 220/345.1 |
| 6,866,442 | B1 * | 3/2005 | Petersen | 403/326 |
| 7,062,817 | B2 * | 6/2006 | Lee | 16/334 |
| 7,137,736 | B2 * | 11/2006 | Pawloski et al. | 383/61.2 |
| 2006/0157483 | A1 * | 7/2006 | Evans et al. | 220/4.22 |
| 2006/0273062 | A1 * | 12/2006 | Delage | 215/237 |

OTHER PUBLICATIONS

PIG® Latching Drum Lid information printed from www.newpig.com.

* cited by examiner

AUTOMATIC LOCKING MECHANISM

BACKGROUND OF THE INVENTION

The present invention generally relates to an automatic locking mechanism for securing a lid to a container.

Hazardous waste, such as volatile organic compounds and chemicals, is commonly stored in containers such as thirty or fifty-five gallon drums. The Environmental Protection Agency (EPA) has imposed stringent regulations regarding spill protection for hazardous waste containers. More particularly, hazardous waste contained within storage containers must be locked when not depositing the hazardous waste in order to prevent the accidental escape of hazardous material.

There are several methods of securing the container lid to the container body. One way to seal the container is by using a bolt ring that bolts the lid to the container. Other methods of securing a lid to the container body include using a screw-on lid and a dual-bung drums with both bungs securely in place. However, it is often difficult to determine using these methods whether a secure seal was obtained between the lid and the body. Further, it can be time-consuming to ensure that a proper seal was created between the lid and the body using these methods.

Accordingly, there is a need for an automatic locking mechanism that fits on a container lid to allow for the "auto-locking" and sealing of the container lid to the container body upon closing in order to facilitate the compliance with the EPA regulations as well as to reduce the amount of human error associated with keeping a container securely locked.

There is an additional need for a quick and simple method to easily determine whether the container lid is open or locked.

BRIEF SUMMARY OF THE INVENTION

According to one embodiment of the present invention, a cover is provided. The cover has an upper side and an underside. The underside comes in physical contact with a container when the cover is in a closed position. A hinge pivotally secures the cover to the container. A lock is secured opposite the hinge and on the underside of the cover. The lock automatically and securely affixes the cover to the container when the cover is in the closed position. A release is positioned on the upper side of the cover to disengage the lock and releases the cover from the container.

According to another embodiment of the present invention, a cover for a container wherein the cover is securely affixed onto a body of the container is provided. The body of the container is formed from elongated sidewalls. The cover has an upper side and an underside. The underside of the cover comes in physical contact with the upper edge of the sidewalls when the cover is in a closed position. The upper edge is colored and the coloring is visible when the cover is an open position. A hinge pivotally secures the cover to the container. A lock is secured opposite the hinge. The lock automatically seals the cover to the upper edge of the sidewalls when the cover is closed.

According to yet another embodiment of the present invention, a cover for a container is provided. The cover is securely affixed onto a body of the container. The body of the container is formed by elongated sidewalls. The cover has an upper side and an underside. The underside is in physical contact with the elongated sidewalls when the cover is closed. A hinge pivotally secures the cover to the body of the container. A handle on the upper side of the cover is secured opposite the hinge. A lock is secured opposite the hinge and is proximate to the handle. The lock automatically locks the cover to the body of the container creating a secure seal when the cover is in the closed position.

Accordingly, it is a feature of at least some embodiments of the present invention to provide a cover fitted onto a container that automatically self-locks the cover to the container when the cover is in the closed position.

It is another feature of at least some embodiments of the present invention to provide for a simple method to quickly and easily determine whether a cover of a container is sealed and in the closed position.

Other features of the embodiments of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

In the following detailed description of illustrative embodiments, reference is made to the accompanying drawings that form a part hereof, and in which are shown by way of illustration, and not by way of limitation, specific embodiments in which the invention may be practiced. It is to be understood that other embodiments may be utilized and that logical, mechanical and electrical changes may be made without departing from the spirit and scope of the present invention.

Figure 1:
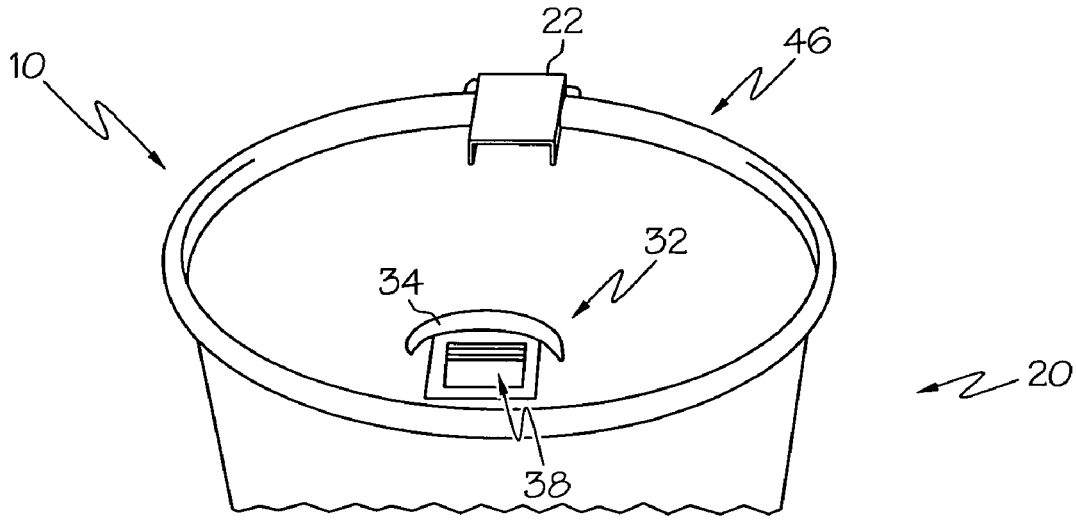
FIG. 1 is a perspective view of an automatic locking cover in the closed position according to one embodiment of the present invention.

Referring to FIG. 1, a container 10 for containing and storing material is illustrated. One type of container 10 that can be used is an open head container. The container 10, as illustrated, comprises a drum but can comprise any other type of open head container designed to store hazardous material such as, for example, a can, a tote bin, a jug or a roll-off box. The container 10 can have elongated sidewalls which form the body 20 of the container 10. The body 20 of the container 10 can have a solid, closed-off bottom and an open end top.

The open head container 10 can have a cover 46 with the same general dimensions as the open end of the container 10. The cover 46 may be opened, or lifted, from the container 10 to add material or to allow for the addition of more material to the container 10. The cover 46 can be securely mated with the open end top of container body 20 to maintain a secure seal between the cover 46 and the sidewalls of the container 10 to prevent the material from spilling or unintentionally escaping from the container 10 into the surroundings. The stored material can be hazardous waste such as volatile organic compounds or chemicals.

The cover 46 can be pivotally secured to the body 20 of the container 10 via a hinge 22. In one embodiment, spring tensions may be applied to hinge 22 to prevent the free-fall of the cover 46 onto the container 10. In addition, a handle 34 may be secured to the cover 46 so that a worker can obtain a better hold of the cover 46 to open the cover 46 to add additional material to the container 10.

Figure 2:
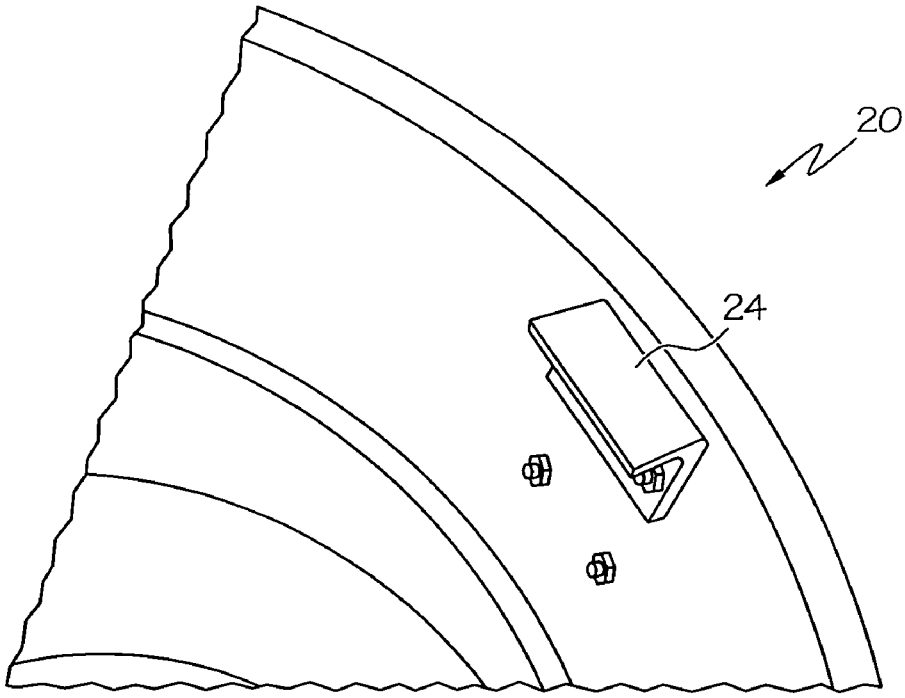
FIG. 2 illustrates the striker element of an automatic locking assembly, as attached to the inside of a container according to one embodiment of the present invention.
Figure 4:
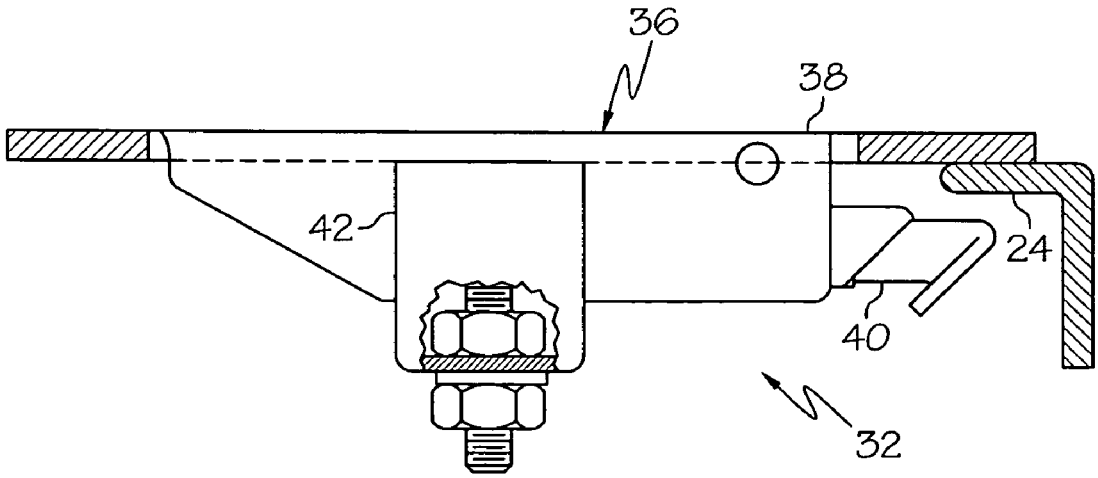
FIG. 4 is a cross sectional view of a paddle latch assembly of an automatic locking cover, according to an embodiment of the present invention.

As illustrated in FIG. 2, the sidewall of the body 20 of the container 10 may have a striker element 24 mounted on it. The striker element 24 may be positioned opposite the hinge 22. In one embodiment, the striker element 24 may be a substantially L-shaped flange that extends outward from the sidewall of the body 20 into the interior of the container 10. The substantially L-shaped flange of the striker element 24 can be configured to automatically engage a latching mechanism 32 that is associated with the cover 46 as illustrated in FIG. 4. The engagement of the latching mechanism 32 with the striker element 24 securely locks, or seals, the cover 46 to the body 20 of the container 10 automatically when the cover 46 is moved to the closed position. The striker element 24 may be made of a non-sparking material. Non-sparking material is a material that will not spark when struck against another object. Examples of non-sparking material include metals such as brass, bronze, aluminum, zinc, Monel metal (copper-nickel alloy), copper-aluminum alloys (aluminum bronze), copper-beryllium alloys (beryllium bronze), and titanium.

Figure 5:
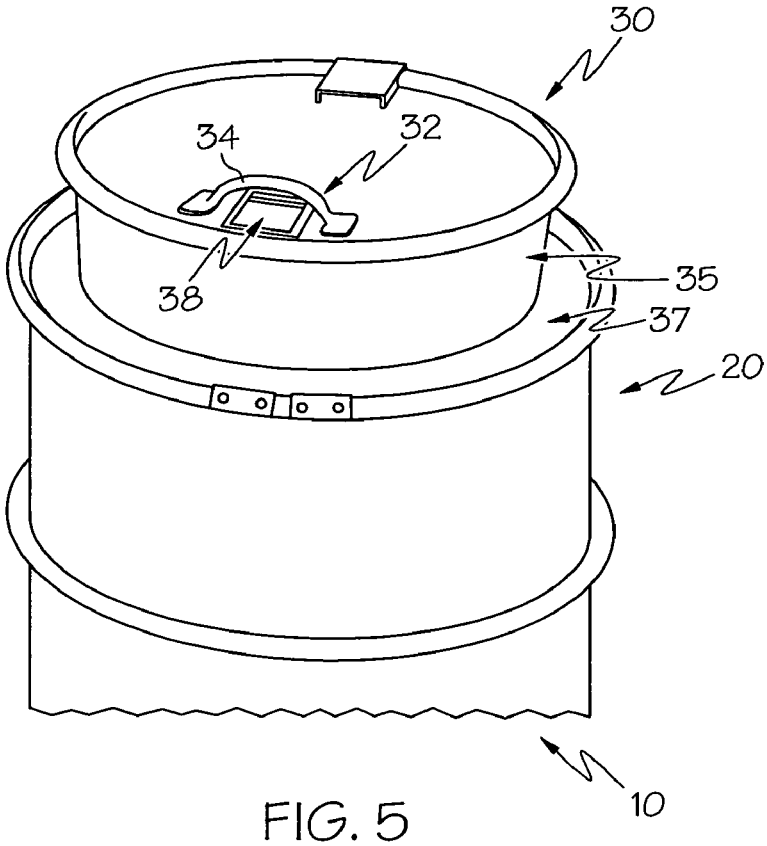
FIG. 5 is a perspective view of an automatic locking cover used in conjunction with a lid body in the closed position according to one embodiment of the present invention.
Figure 6:
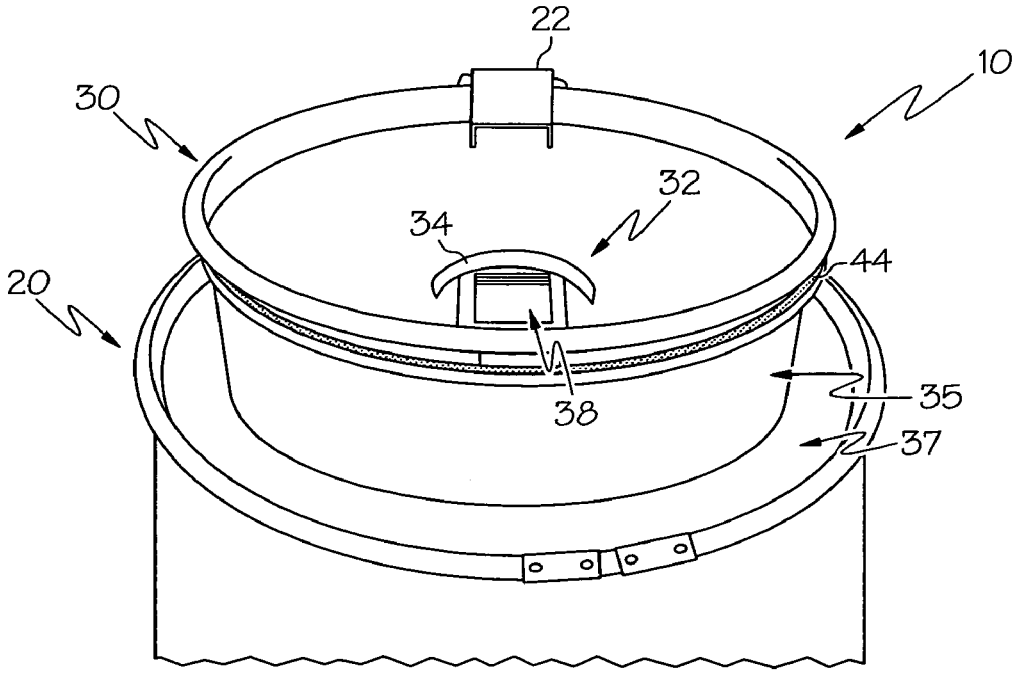
FIG. 6 is a perspective view of an automatic locking cover used in conjunction with a lid body in the open position according to one embodiment of the present invention.

The automatic latching mechanism 32 can be mounted to the underside of the cover 46 with, for example, a mounting bracket 42. As illustrated in FIGS. 1, 5 and 6, the automatic latching mechanism 32 may be located opposite of the hinge 22 on the underside of the cover 46 in the proximity of the handle 34. In addition, a release 38 may be provided on the upper side of the cover 46 in the general proximity of the handle 34 as illustrated in FIGS. 1 and 4-6. The release 38 unlocks, or unseals, the cover 46 from the body 20 of the container 10. The release 38 can be actuated using one hand. The release 38 may also be actuated while holding the handle 34 which allows a worker to open, or unseal, the cover 46 and to lift the cover 46 into an open position with one hand.

Figure 3:
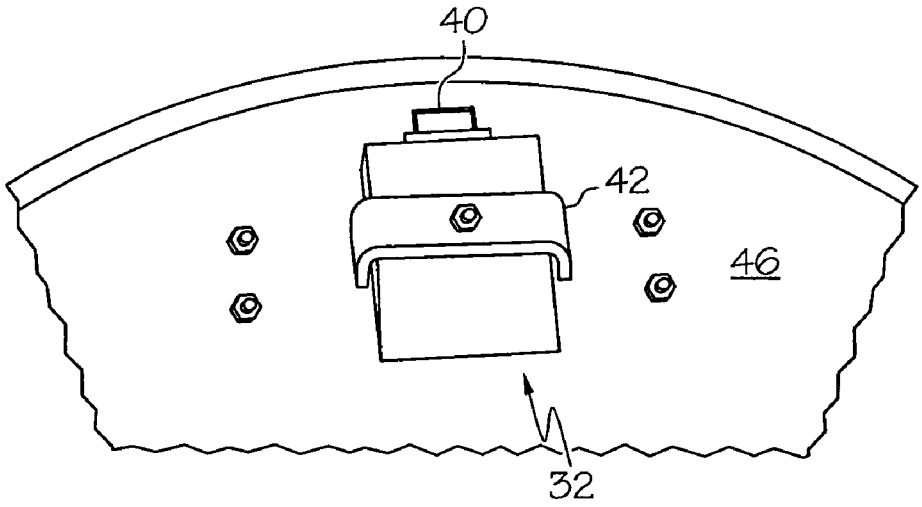
FIG. 3 is a bottom view of a latching mechanism on the underside of an automatic locking cover, according to one embodiment of the present invention.

In one embodiment, the automatic latching mechanism 32 may comprise a latch assembly 36, such as, for example, a sliding, slam type paddle latch. In this embodiment, the paddle latch includes a striker element 24, a release 38 and a slide 40. FIG. 4 illustrates a cross sectional view of a paddle latch mechanism 36 of an automatic locking cover 46. As discussed above and illustrated in FIGS. 3 and 4, the paddle latch assembly 36 may be secured to the cover 46 of the container 10 via mounting bracket 42. The slide 40 can be made of high strength low alloy steel, stainless steel, die cast zinc, powder metal, plastic, or any other suitable material. The paddle latch assembly 36 can be actuated by the release 38 that can be connected to the slide 40. The slide 40 engages the striker element 24 and rests beneath the striker element 24, when the cover 46 is in physical contact with the body 20 of the container 10, to automatically hold the cover 46 in the closed position. In operation, the cover 46 may be opened by pulling upward on the release 38 of the paddle latch assembly 36, thereby disengaging the slide 40 from striker element 24 by sliding the slide 40 out from under the substantially L-shaped flange of the striker element 24 and in towards the interior of the latch assembly 36 and towards the center of the cover 46. The cover 46 may be securely closed and sealed by simply dropping the cover 46 towards container 10 and allowing the angled surface of the slide 40 to contact the striker element 24, slide inwardly due to the contact, slide back outwardly after the striker element 24 is cleared, and the rest under the substantially L-shaped flange of the striker element 24, in order to securely hold the cover 46 in the closed position.

In another embodiment, the automatic latching mechanism 32 may comprise a trigger activated latching mechanism. In this embodiment, a detent is connected to the release 38, or a trigger, on the upper side of the cover 46. The detent can be engagable with the striker element 24 mounted on the sidewall of the container 10. The actuation of the release 38 causes the detent to move from a latched position in which the detent engages the striker element 24 for latching the cover 46 closed to an unlatched position in which the detent can be disengaged from the striker element 24 for allowing the cover 46 to be opened. The release 38 can be actuated by pressing down on the release 38 which disengages the detent. The cover 46 may be automatically and securely closed and sealed by simply dropping the cover 46 towards container 10 and allowing the detent to engage the striker element 24. However, any type of automatic latching mechanism 32 assembly can be incorporated with the container 10 to achieve the foregoing automatic closing and sealing of the cover 46 to the container body 20, such as, for example a spring-loaded latching mechanism or a magnetic latching mechanism.

In another embodiment, such as that illustrated in FIG. 5, the container 10 also comprises a lid body 30, having sidewalls 35 and a lower skirt 37 extending outwardly from the sidewalls 35 between the container body 20 and the cover 46, as illustrated in FIG. 5. The bottom edge of the lid body 30 can have a three dimensional shape that can be substantially the same two-dimensional shape as the open end top of the container 10. The upper edge 44 defined by the sidewalls 35 has a diameter smaller than the diameter of the container 10 so as to provide a stepped cap configuration. The lid body 30 is securely affixed to the sidewalls of the body 20 of the container 10 by the use of a bolt ring or any other method that ensures that the lid body 30 is tightly attached and sealed to the body 20 of the container 10. The lid body 30 can be comprised of a non-corrosive material such as steel. The lid body 30 is hollow to allow for the passage of material through the lid body 30 into the container body 20.

FIG. 6 illustrates a top view of the container 10 with the cover 46 of the lid body 30 in the open position. The upper edge 44 of the sidewalls 35 of the lid body 30 is colored or shaded in a high-contrast (relative to the container 10 and/or cover 46) easily visible color as a simple method for the worker to quickly determine at a glance that the cover 46 is open and is not securely sealed to the container body 20. The upper edge 44 can be colored yellow or any other high-contrast color that can be easily seen or noticed by the worker.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible More specifically, although some aspects of the present invention are identified herein as preferred or particularly advantageous, it is contemplated that the present invention is not necessarily limited to these preferred aspects of the invention.

What is claimed is:

1. A cover comprising:

an upper side;

an underside configured to come in physical contact with a container when said cover is in a closed position;

a hinge configured to pivotally secure said cover to said container;

a lock secured opposite said hinge and on said underside of said cover, wherein said lock is configured to automatically and securely affix said cover to said container when said cover is moved to said closed position;

a release on said upper side of said cover configured to disengage said lock and release said cover from said container; and a handle secured on said upper side of said cover above said release and operable in conjunction with said release such that said release is actuated to disengage said lock at the same time said handle is gripped when opening said cover.

2. The cover of claim 1, wherein said handle and said release are positioned to actuate opening of said cover using one hand.

3. The cover of claim 1, wherein said lock comprises one of a paddle latch assembly, a trigger activated latching assembly, a spring-loaded latching assembly, a magnetic latching assembly, and combinations thereof.

4. The cover of claim 1, wherein said lock further comprises:

a detent located on said underside of said cover and configured to automatically engage a striker element located on a side wall of said container, wherein said release is configured to disengage said detent from said striker element and allow said cover to move into an open position.

5. The cover of claim 1, wherein said lock further comprises:

a slide located on said underside of said cover configured to automatically engage a striker element located on a side wall of said container upon closing said cover, wherein said release is configured to disengage said slide from said striker element and allow said cover to move into an open position.

6. The cover of claim 5, wherein said slide of said lock is configured to retract until said slide clears said striker element, wherein said slide is configured to rebound inwardly and to rest beneath said striker element to prevent upward movement of said cover.

7. The cover of claim 5, wherein said slide of said lock comprises an angled surface.

8. The cover of claim 5, wherein said striker element of said lock is substantially a L-shaped flange extending outward into the interior of said container.

9. The cover of claim 5, wherein said striker element of said lock is non-sparking.

10. The cover of claim 1, wherein said hinge further comprises springs to prevent the free-fall of said cover of said container.

11. A self-locking container system, the system comprising:

a container having elongated sidewalls forming a body of said container and an inwardly extending lip element;

a cover having:

an upper side;

an underside, wherein said underside comes into physical contact with said elongated sidewalls when said cover is in a closed position;

a hinge that pivotally secures said cover to said body of said container;

a lock, wherein said lock includes a movable element having a contact surface configured to engage said lip element and to move inwardly upon pivotally closing said cover to said container, wherein said movable element is further configured to extend outwardly upon clearing said lip element such that at least a portion of said movable element rests beneath said lip element when said cover is in said closed position;

a release on said upper side of said cover configured to disengage said lock and release said cover from said container; and a handle secured on said upper side of said cover above said release and operable in conjunction with said release such that said release is actuated to disengage said lock at the same time said handle is gripped when opening said cover.

12. The self-locking container system of claim 11, wherein said movable element comprises a slide configured to slide generally parallel with said upper side of said cover, and wherein the contact surface of said slide comprises an angled surface.

13. The self-locking container system of claim 11, wherein said movable element comprises a detent configured to automatically engage said lip element.

14. The self-locking container system of claim 11, wherein said lip element comprises a striker element.

* * * * *